US005314002A

United States Patent [19]

VanRens et al.

[11] Patent Number: 5,314,002

[45] Date of Patent: May 24, 1994

[54] VACUUM VALVE APPARATUS FOR DIE CASTING

[75] Inventors: Russell J. VanRens, Milwaukee, Wis.; Donald L. Lessard, Antioch, Ill.

[73] Assignee: Outboard Marine Corporation, Waukegan, Ill.

[21] Appl. No.: 49,766

[22] Filed: Apr. 19, 1993

Related U.S. Application Data

[63] Continuation-in-part of Ser. No. 874,629, Apr. 27, 1992, Pat. No. 5,203,396.

[51] Int. Cl.[5] ..... B22D 17/14; B22D 17/20

[52] U.S. Cl. ..... 164/305; 164/253

[58] Field of Search ..... 164/305, 410, 253, 254, 164/61, 63, 65, 113

[56] References Cited

U.S. PATENT DOCUMENTS

| | | | |
|---|---|---|---|
| 4,240,497 | 12/1980 | Glazunov et al. . | |
| 4,431,047 | 2/1984 | Takeshima et al. | 164/253 |
| 4,463,793 | 8/1984 | Thurner . | |
| 4,538,666 | 9/1985 | Takeshima et al. | 164/305 |
| 4,574,867 | 3/1986 | Thompson . | |
| 4,691,755 | 9/1987 | Kuriyama et al. | 164/305 |
| 4,722,385 | 2/1988 | Yamauchi et al. | 164/305 |
| 4,871,010 | 10/1989 | Dannoura . | |
| 5,022,457 | 6/1991 | Iwamoto et al. . | |
| 5,086,824 | 2/1992 | Tsuda et al. . | |
| 5,201,358 | 4/1993 | Stummer et al. . | |
| 5,211,216 | 5/1993 | Drury et al. . | |

FOREIGN PATENT DOCUMENTS

| | | | |
|---|---|---|---|
| 62-214861 | 9/1987 | Japan | 164/305 |
| 63-93462 | 4/1988 | Japan | 164/305 |
| 2-192866 | 7/1990 | Japan | 164/305 |

*Primary Examiner*—J. Reed Batten, Jr.
*Attorney, Agent, or Firm*—Welsh & Katz, Ltd.

[57] ABSTRACT

The vacuum valve apparatus is used in die casting equipment of the type which utilize a source of vacuum pressure in an internal die cavity for making a casting. The apparatus includes a valve body that has components that are separable along a split line that is positioned to facilitate removal of casting material from internal ports that may result in the event of a malfunction.

24 Claims, 5 Drawing Sheets

VACUUM VALVE APPARATUS FOR DIE CASTING

This is a continuation-in-part of Ser. No. 874,629 filed Apr. 27, 1992, and now U.S. Pat. No. 5,203,396.

The present invention generally relates to die casting apparatus and more particularly relates to a vacuum valve apparatus that is useful for die casting operations.

It is generally known that metal die casting operations produce improved quality castings if the die cavity in which the casting is formed is evacuated of air prior to injection of the casting material into the cavity. While there have been many different designs for producing valves for communicating a source of vacuum with the die cavity, many of these designs have exhibited less than desirable operating characteristics and are often unreliable during use. One such vacuum valve apparatus generally comprises a reciprocating poppet valve which extends into the die cavity when it is opened and it is closed by the contact with the molten casting material that is injected into the cavity. Because there is a distinct tendency of molten material to flow behind the valve, it often does not seal properly because of the presence of such material. When the valve is contaminated, the die casting operation must be interrupted and the valve mechanism cleaned out which results in expensive down time and interferes with a desired production schedule.

Accordingly, it is an object of the present invention to provide an improved vacuum valve apparatus for die casting operations which valve apparatus exhibits reliable operation and is not easily obstructed or contaminated.

Another object of the present invention is to provide such an improved valve apparatus which in the event that it does become obstructed, is easily disassembled and cleaned.

Still another object of the present invention is to provide such an improved valve apparatus which is simple in design, and contains the capability of being effective in evacuating the die cavity which promotes improved quality castings, and yet is reliable in that if a malfunction occurs and the valve does not close at the appropriate time, casting material can be relatively easily removed. The valve apparatus is adapted to be easily connected to a trap and filter structure to prevent casting material from contaminating the vacuum source.

Yet another object of the present invention lies in the provision of being able to inject a blast of air near the valve itself to clean any residual flash that may be present, and also to cool the valve and thereby contribute to reliable continued operation.

Still another object of the present invention lies in the provision of utilizing relatively common components that can be easily assembled and disassembled for maintenance and is economical in its construction.

Another object of the present invention is to provide a valve apparatus that has a body comprised of components that are separable along a split line that intersects internal passages that could become filled with metal as a result of a malfunction, while also utilizing standard automotive exhaust poppet valve components that enable easy repair and maintenance in the event of such a malfunction.

A more detailed object is to provide such a valve body where the split line intersects the passage where the valve is located, but where the valve apparatus operation is not impaired because standard valve seat and guide components are used to isolate the moving valve components from contacting the body at the interface defined by the split line.

Other objects and advantages will become apparent upon reading the following detailed description while referring to the attached drawings in which.

DETAILED DESCRIPTION

Broadly stated, the present invention relates to a vacuum valve apparatus for use in vacuum die casting equipment which is used to manufacture high quality casting products that do not have surface spalling and the like. Such surface anomalies are generally a result of air being present in the die cavity when the casting material is injected into the die cavity. The vacuum valve is used to communicate the die cavity with a source of vacuum for the purpose of evacuating air from the die cavity immediately prior to injection of the casting material into the die cavity. In U.S. patent application Ser. No. 874,755 assigned to the same assignee as the present invention, a solenoid arrangement operates the valve apparatus in a manner whereby the valve apparatus can be very rapidly closed so that casting material will not impede the sealing of the poppet valve. It should be understood that in a die casting operation, the casting material is injected into the die cavity at extremely fast speed and under very high pressure. It is preferred that the injection of material occurs in approximately 30 milliseconds and that the vacuum valve apparatus of the present invention is desirably closed in approximately 15 milliseconds. By virtue of the solenoid valve invention of U.S. patent application Ser. No. 874,755, such rapid movement of the poppet valve is possible.

The present invention is directed to the vacuum valve apparatus that has many desirable attributes in that it has a valve body that is comprised of two components which are separable so that in the event of a malfunction of the valve, the internal ports or passages can be exposed and any casting material that may enter the valve body due to failure of the valve to seal can be relatively easily removed compared to known prior art designs. The valve apparatus also utilizes a relatively standard four cycle automotive exhaust poppet valve and components that are relatively inexpensive and readily available. The valve apparatus is sufficiently large that the air in the die cavity can be rapidly evacuated thereby producing vacuum levels that are likely to produce high quality castings. The valve also has a means for injecting air under positive pressure into the area of the valve itself to cool the same.

Figure 1:
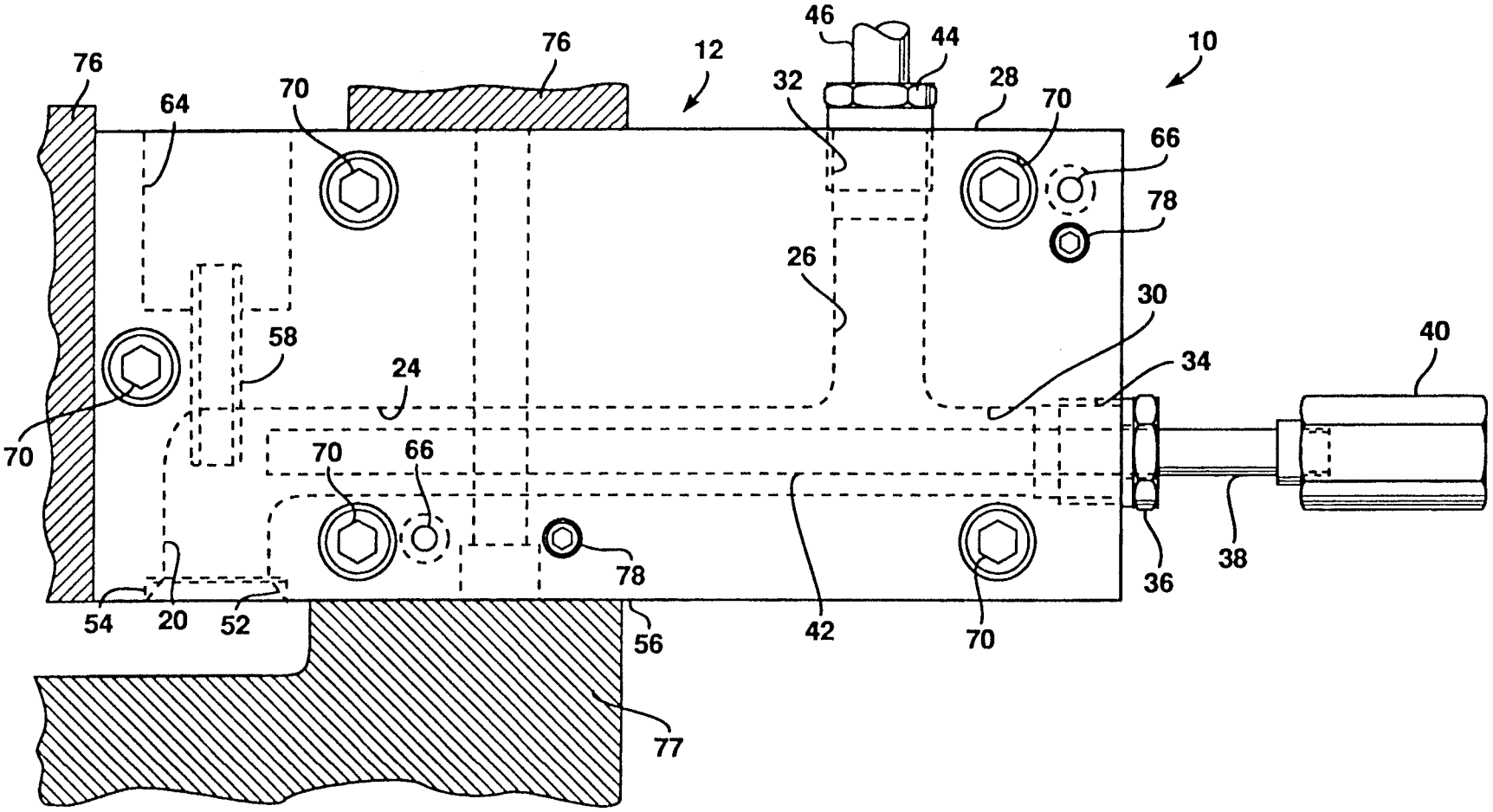
FIG. 1 illustrates a top view of the vacuum valve apparatus embodying the present invention, with portions omitted.
Figure 2:
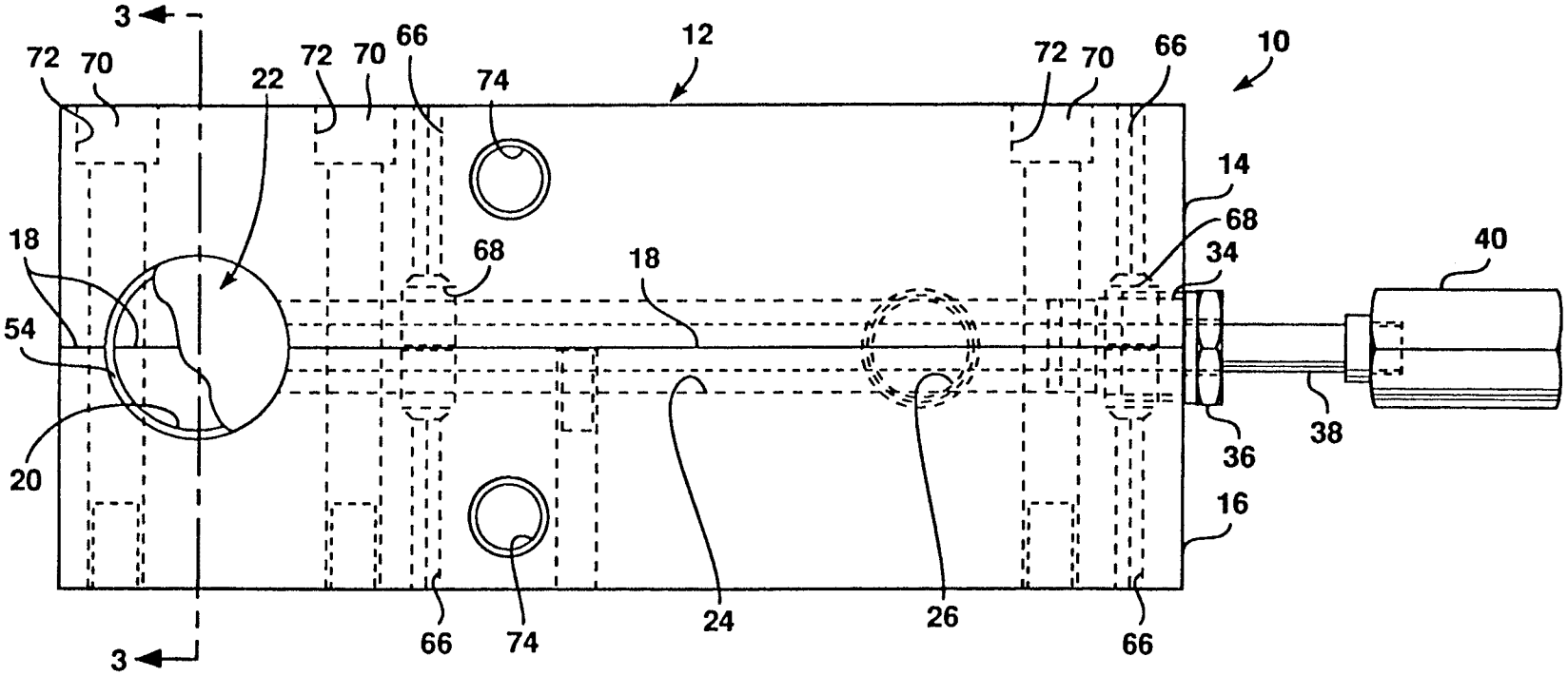
FIG. 2 is a front view of the vacuum valve apparatus shown in FIG. 1.
Figure 3:
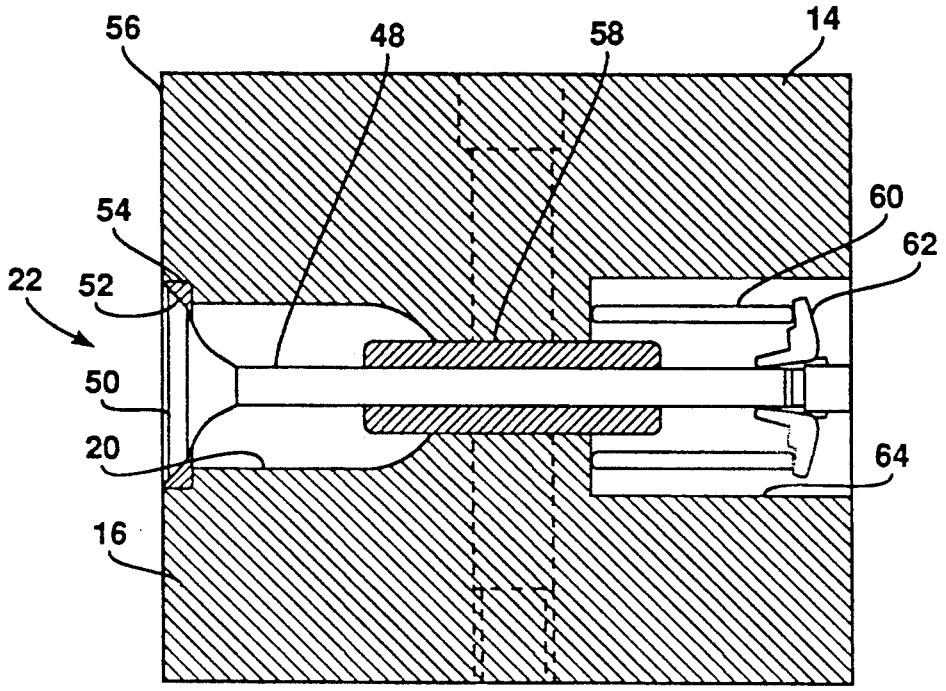
FIG. 3 is a cross section of a vacuum valve apparatus embodying the present invention and is taken generally along the line 3—3 of FIG. 2.
Figure 4:
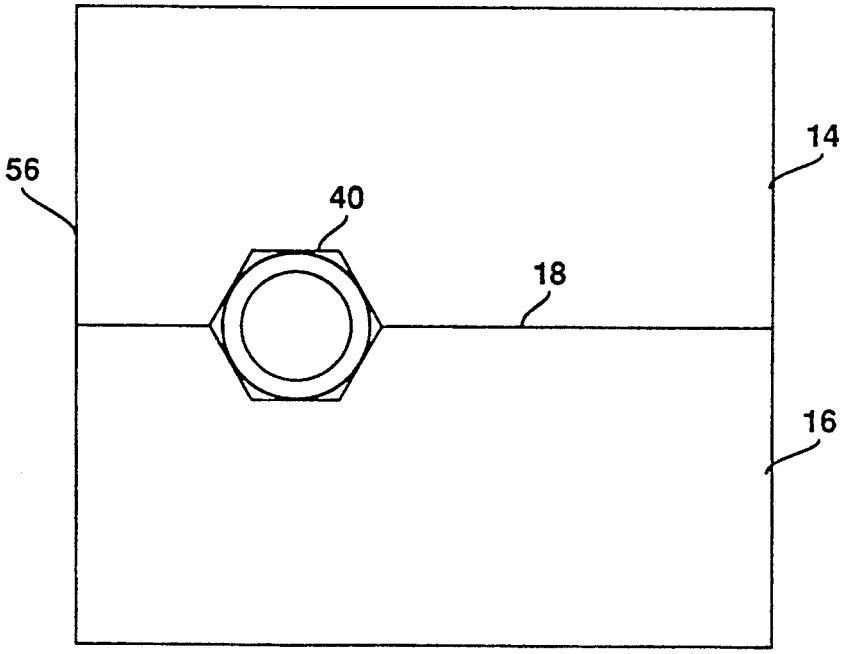
FIG. 4 is an end view of the apparatus shown in FIG. 2, and is taken from the right end of FIG. 2.

Turning now to the drawings, and particularly FIG. 1, the vacuum valve apparatus embodying the present invention is shown generally at 10, and includes a valve body, indicated generally at 12, which comprises two components 14 and 16 which are removably attached to one another along a split line 18, best shown in FIGS. 2 and 3. As best shown in FIG. 2, the split line 18 is preferably located to intersect the internal ports or passages that are in communication with the die cavity when the valve is open. If casting material does enter the internal ports due to a malfunction of the valve, separation of the components 14 and 16 will expose the material located in the ports and enable the material to be removed from the passages of the components 14 and 16.

The valve body 12 has a first generally cylindrically shaped recess or port 20 which is located in the left portion of the valve apparatus 10 as shown in FIGS. 1 and 2, in which a poppet valve, indicated generally at 22, is located. The port 20 merges with a transverse port portion 24 that extends toward the right end as shown in FIGS. 1 and 2, and it connects to another transverse port portion 26 that extends to the rear face 28 of the body. There is a port portion 30 that extends from the port portions 24 and 26 to the right end of the valve body as shown in FIGS. 1 and 2. The ports 26 and 30 have threaded portions 32 and 34, respectively, so that fittings can be securely attached.

With respect to the threaded portion 32, it is adapted to be connected to a fitting that extends to a vacuum source (not shown) and a filter trap mechanism may be provided in the line between the fitting and the vacuum source to effectively isolate the valve apparatus from the vacuum source, so that casting material will not travel to the vacuum source and damage it if a malfunction occurs.

The portion of the port 24 that extends to the right in FIG. 1 beyond the port 30 communicates with a source of positive air pressure via connector 36, a short nipple 38 and a cascade junction fitting 40 that in turn is connected to a source of positive air pressure (not shown). The ports 24 and 30 includes an inner tube 42 through which air is communicated to the first port 20 for the purpose of providing a blast of air to clear the valve 22 of any flash that may be present and also for the purpose of cooling the valve 22.

The threaded portion 32 is adapted to receive a connector 44 which secures a conduit 46 that extends to a source of vacuum (not shown). The conduit 46 may be sufficiently long that any casting metal that may be introduced into the ports 24 and 26 or the conduit 46 itself will not travel to the source of vacuum. Alternatively, if the conduit is relatively short, then a trap and filter mechanism can be connected in the conduit between the connector 44 and the vacuum source.

In accordance with an important aspect of the present invention, the poppet valve 22 comprises an elongated valve stem 48 and an enlarged head, indicated generally at 50, with the head having a beveled surface 52 that is of the same size and angular orientation as a similar bevel formed in a valve seat 54 that is fitted in an enlarged portion of the port 20 located at the front face 56 of the valve body 12. The seat 54 is a standard valve component that is available from such companies as NAPA or Perfect Circle. The seat is of a unitary construction and is located within the enlarged portion of the port 20, and spans the split line so that the sealing surfaces of the valve head and the seat are not affected by the presence of the split line in the valve body 12. The seat 54 is sized relative to the enlarged portion to provide an interference fit which retains the seat in place. While the seat 54 fits tightly, it is not air tight, but is sufficiently close to keep metal from going around the seat between the seat and the body components.

As is apparent from FIGS. 1 and 2, the split line 18 generally bisects the port 20 as well as the ports 24, 26 and 30, so that if molten casting material does enter these ports, separation of the components 14 and 16 will expose the material that is present in the ports so that it can be removed. While the split line does not necessarily have to exactly bisect the ports, it is preferred that it does, for the reason that the split line will be located at the largest diameter of each half of each of the ports. This will not result in any locking in of the material, which could hinder the removal of such material.

It is also preferred that the valve stem 48 slidingly fit in a cylindrical valve guide 58 which is also preferably of standard construction and available from NAPA or Perfect Circle. The valve guide 58 is positioned in a smaller diameter port that extends from the port 20 to a recess 64 located in the rear of the body 12. The guide 58 has an internal diameter that is sized to receive the valve stem 48 and permit axial movement of the valve stem while reducing any air movement between the valve stem and the body 12. The guide 58 also extends across the split line 18 so that the split line does not interfere with the reciprocating movement of the valve. Stated in other words, the guide 58 provides a round hole through which the valve stem can reciprocate, which may not otherwise be provided if the two body components 14 and 16 were not accurately aligned.

An advantage in the use of the valve seat and the valve guide in the construction illustrated is that if there is contamination by introduction of casting material into the recess and valve due to a malfunction, the valve apparatus can be easily rebuilt by removing the casting material from all ports where it is located, and installing a new valve seat, valve guide and a new valve 22. Because these valve components are readily available at modest cost, it is preferred that new components be installed rather than attempting to reclaim the components that had become fouled.

At the opposite end of the stem, i.e., to the right as shown in FIG. 3, a spring 60 is provided for biasing the valve 22 toward a closed position, and a spring retainer member 62 is provided and is attached to the stem in a conventional manner as is well known in the automotive art. The spring 60 is located in the cylindrical recess 64 and bears against the retainer member 62 and biases the valve 22 closed. It is at this end of the stem that the Double Solenoid Valve Actuator of U.S. patent application Ser. No. 874,755 is operatively attached to open and close the valve apparatus of the present invention.

The components 14 and 16 also have apertures 66 located within them adapted to receive cylindrical positioning mandrels 68 to accurately position the components relative to one another. After the mandrels 68 are inserted, then socket head set screws 70 or the like can be inserted in associated apertures 72 for bolting the components 14 and 16 together.

The components 14 and 16 also have apertures 74 for attaching the valve body to a moveable die portion 76 using set screws (not shown) similar to set screws 70. A stationary die portion 77 is also illustrated.

There are two smaller set screws 78 located in apertures which extend through the component 16 but not through component 14. These set screws 78 can be rotated to apply a separating force on the components 14 and 16 after the valve apparatus has been removed from the die and the set screws 70 have been removed to separate the two components that may be locked together by hardened casting material in the ports and/or valve components.

Figure 5:
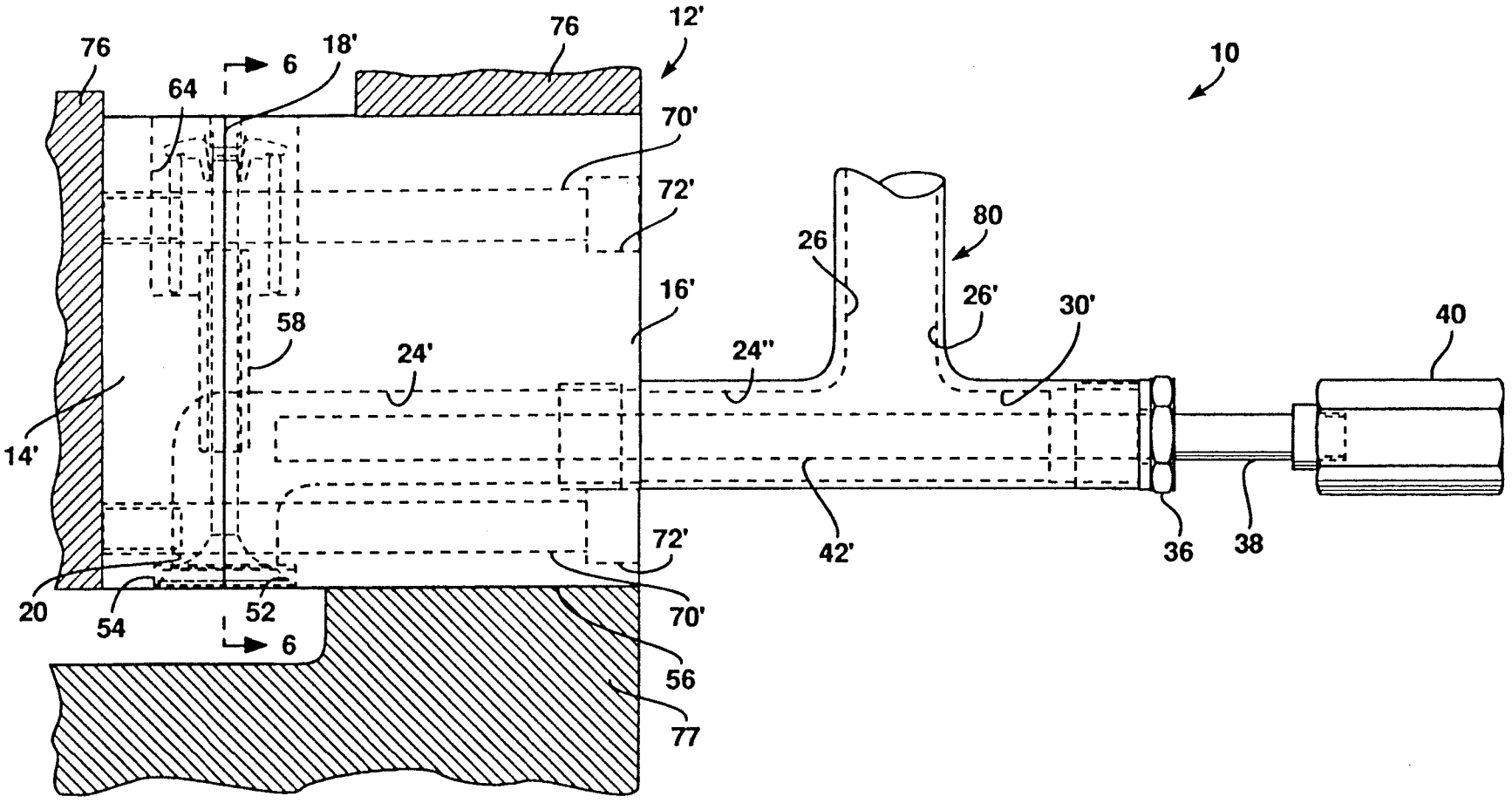
FIG. 5 illustrates a top view of the vacuum valve apparatus embodying the present invention, with portions omitted; and, FIG. 6 is a view, partially in cross section, of the embodiment of the vacuum valve apparatus shown in FIG. 5, and is taken generally along the line 6—6 of FIG. 5.
Figure 6:
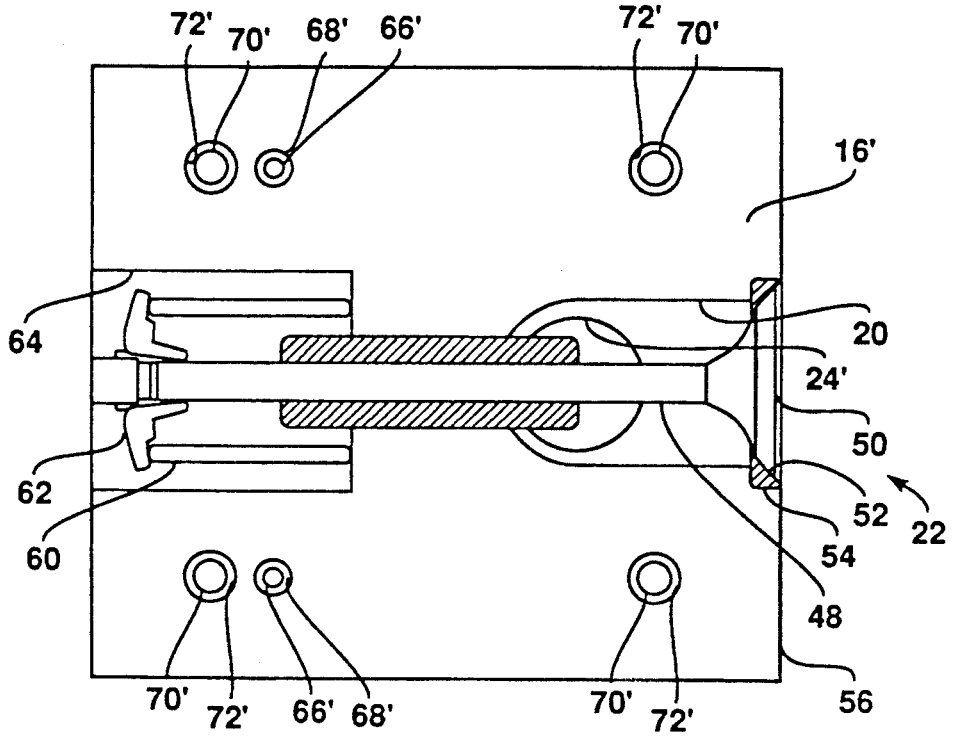

In accordance with another important aspect of the present invention, another embodiment of the valve apparatus is shown in FIGS. 5 and 6, where identical reference numbers have been used to identify features that are common with the embodiment shown in FIGS. 1 through 4. Where a component or feature is shown in FIGS. 5 and 6 that is similar but not identical to those shown in FIGS. 1 through 4, a reference number having a prime (') designation will be used in FIGS. 5 and 6.

The apparatus 12' has two body components 14' and 16', but the split line 18, is oriented differently than in the embodiment shown in FIGS. 1–4. As shown in FIG. 5, the component 14' comprises the leftward portion of the vertical oriented split line 18' and the component 16' is the portion of the body to the right of the split line 18'. The overall length of the body is less than the FIG. 1 embodiment, and the T-shaped configuration of the internal ports 24, 26 and 30 are replaced by a T-shaped pipe fitting 80 having interior portions 24'', 26' and 30'. The conduit 42' is still provided and extends through the port 24' as well as through portions 24'' and 30'.

Because the split line 18' does not extend along the port 24' (as the split line 18 did extend along port 24), the body components do not separate along the port 24'. However, separation of the components 14' and 16' will permit access to the port 24' from both ends and metal can be removed by drilling or punching it from the port 24'. To facilitate such removal, it is preferred that the port 24' be gradually increasing in size from one end to the other. As shown in FIG. 5, the port 24' is circular in cross section and gradually increases in diameter along its length from right to left. It should be understood that it could increase in size in either direction.

The pipe fitting 80 is preferably attached to the body component 16' by a threaded connection in both the port 24' and end of the fitting 80. Set screws 70' are fit within apertures 72' which are oriented in a different direction than the apertures 72 of FIGS. 1–4) to hold the components 14' and 16' together. Positioning dowels 68' are also provided.

From the foregoing detailed description, it should be appreciated that an improved vacuum valve apparatus has been shown and described which offers many desirable advantages and attributes compared to prior valve apparatus designs. The apparatus provides adequate communication of vacuum so that air will be quickly evacuated from the die cavity. The use of conventional valve components results in reliable performance at a reasonable cost. The use of valve body components that are separable at a desired position enables relatively easy clearing of internal ports that may become obstructed due to a malfunction during operation.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A vacuum valve apparatus for use in a die casting means, the die casting means being of the type which utilizes a source of vacuum pressure and a die body having internal surfaces which define an internal die cavity for making a casting, said apparatus comprising:

a valve body adapted to be mounted to the die body, said valve body having at least one face that is generally coextensive with an internal surface of the die cavity, said valve body having a first internal port means adapted to receive a valve means, a second internal port means communicating said first port means to the source of vacuum pressure, said first port means terminating at said one face and being in communication with said die cavity;

an openable and closeable valve means housed in said first internal port means of said valve body and communicating said first port means with the die cavity when said valve means is open and isolating the first port means from the die cavity when said valve means is closed;

said valve body having at least two body components that are separable from one another along a split line, said split line being located along at least said first internal port means, so that separating said valve body components enables any casting material to be removed from said first and second internal port means.

2. Apparatus as defined in claim 1 further including a conduit means located within at least a portion of said second internal port means for communicating a source of positive air pressure to said first internal port means.

3. Apparatus as defined in claim 1 wherein said split line is also located along said second internal port means.

4. Apparatus as defined in claim 2 wherein said valve body includes a third internal port means for communicating said first port means to the exterior of said valve body, said conduit means being located in said third internal port means and a portion of said second port means.

5. Apparatus as defined in claim 1 wherein body components includes a plurality of threaded apertures, other of said valve body components having cooperative apertures aligned with said threaded apertures so that threaded bolt means can be inserted through said cooperative apertures into said threaded apertures to secure the valve body, components together.

6. Apparatus as defined in claim 5 including at least two sets of locating apertures in each of said valve body components with one locating aperture of each set being positioned in each valve body component and being aligned with the other locating aperture of each set, the other locating aperture being positioned in an adjacent valve body component, and means adapted to be inserted into each set of aligned apertures to accurately position the valve body components relative to one another prior to insertion of said threaded bolt means.

7. Apparatus as defined in claim 1 wherein said second port means extends to an exterior surface of said valve body.

8. Apparatus as defined in claim 1 wherein said valve means comprises a poppet valve having an elongated valve stem and an enlarged valve head located at one end thereof, said valve means having a biasing means operatively connected to the end portion opposite said one end, said biasing means biasing said poppet valve toward a closed position.

9. Apparatus as defined in claim 8 wherein said apparatus includes a valve seat means located in said first port means adjacent said one face, said seat means having a sealing surface adapted to seat said poppet valve head, said apparatus having a fourth port means in a second face of said valve body opposite said one face, said fourth port means receiving said biasing means, and a fifth port means communicating said first and fourth port means.

10. Apparatus as defined in claim 9 further including a valve guide means located in said fifth port means, said guide means having a generally cylindrical bore with an inside diameter sized to receive said valve stem in close fitting relation to enable sliding movement thereof while generally preventing fluid communication therethrough.

11. Apparatus as defined in claim 10 wherein said first, fourth and fifth port means are generally concentrically aligned, said split line being located to intersect each of said first, fourth and fifth port means.

12. Apparatus as defined in claim 9 wherein said valve sealing surface has a conical shaped bevel, and said valve head has a similar cooperatively fitting shape.

13. A vacuum valve apparatus for use in a metal die casting machine, the die casting machine being of the type which has a die body having internal surfaces which define an internal die cavity for making a metal casting, the machine utilizing a source of vacuum pressure for evacuating the die cavity immediately before a casting operation, said apparatus comprising:

a valve body adapted to be attached to said die body, said valve body having at least a front face that is generally coextensive with an internal surface of the die cavity, said valve body having a first internal port means adapted to receive a valve means, a second internal port means communicating said first port means with the source of vacuum pressure, said first port means terminating at said front face and being in communication with said die cavity;

an openable and closeable valve means housed in said first internal port means of said valve body and communicating said first port means with the die cavity when said valve means is open and isolating the first port means from the die cavity when said valve means is closed;

said valve body having at least two body components that are separable from one another along a split line, said split line being located along at least said first internal port means whereby the same is formed in each of said valve body components, so that separating said valve body components exposes a substantial portion of at least said first internal port means to enable any casting material to be removed therefrom.

14. Apparatus as defined in claim 13 wherein said valve body includes a third internal port means for communicating at least said first port means to the exterior of said valve body.

15. Apparatus as defined in claim 14 wherein said third internal port means is connected to a source of positive air pressure for providing a blast of air for the purpose of blowing metal flash from said valve means and for cooling the valve means following a casting operation.

16. Apparatus as defined in claim 15 further including a conduit means located within a portion of said second port means and extending to a location near said first port means for communicating a source of positive air pressure to said first internal port means.

17. Apparatus as defined in claim 13 wherein one of said valve body components includes a plurality of threaded apertures, other of said valve body components having cooperative apertures aligned with said threaded apertures so that threaded bolt means can be inserted through said cooperative apertures into said threaded apertures to secure the valve body components together.

18. Apparatus as defined in claim 13 including at least two sets of locating apertures in each of said valve body components with one locating aperture of each set being positioned in each valve body component and being aligned with the other locating aperture of each set, the other locating aperture being positioned in an adjacent valve body component, and means adapted to be inserted into each set of aligned apertures to accurately position the valve body components relative to one another prior to insertion of said threaded bolt means.

19. Apparatus as defined in claim 13 wherein said valve means comprises a poppet valve having an elongated valve stem and an enlarged valve head located at one end thereof, said valve means having a biasing means operatively connected to the end portion opposite said one end, said biasing means biasing said poppet valve toward a closed position.

20. Apparatus as defined in claim 19 wherein said apparatus includes a valve seat means located in said first port means adjacent said one face, said seat means having a sealing surface adapted to seat said poppet valve head, said apparatus having a fourth port means in a rear face of said valve body opposite said front face, said fourth port means receiving said biasing means, and a fifth port means communicating said first and fourth port means.

21. Apparatus as defined in claim 20 further including a valve guide means located in said fifth port means, said guide means having a generally cylindrical bore of a size to receive said valve stem in close fitting relation to enable sliding movement thereof while generally preventing fluid communication therethrough.

22. Apparatus as defined in claim 21 wherein said split line intersects each of said first, fourth and fifth port means.

23. Apparatus as defined in claim 20 wherein said valve sealing surface has a conical shaped bevel, and said valve head has a similar cooperatively fitting shape.

24. Apparatus as defined in claim 13 wherein said second internal port means extends from said first internal port means to the outside surface of said body, said second internal port means having a gradually increasing size from one end thereof to the other.

* * * * *